United States Patent [19]

Kellner

[11] 4,082,373

[45] Apr. 4, 1978

[54] TANDEM ROLLER STABILIZER FOR EARTH BORING APPARATUS

[75] Inventor: Jackson M. Kellner, Midland, Tex.

[73] Assignee: Smith International, Inc., Midland, Tex.

[21] Appl. No.: 721,090

[22] Filed: Sep. 7, 1976

[51] Int. Cl.[2] ..... E21B 17/10

[52] U.S. Cl. ..... 308/4 A; 166/241; 175/325; 175/406; 308/8.2

[58] Field of Search ..... 308/4 R, 4 A, 8.2; 166/241; 175/76, 406, 408, 325, 73

[56] References Cited

U.S. PATENT DOCUMENTS

| | | | |
|---|---|---|---|
| 1,776,611 | 9/1930 | Akeyson | 175/406 |
| 3,400,773 | 9/1968 | Tiraspolsky et al. | 175/325 |
| 3,413,045 | 11/1968 | Wohlfeld | 308/6 |
| 3,463,270 | 8/1969 | Lundstrom et al. | 308/8.2 |
| 3,982,594 | 9/1976 | Berthiaume | 308/8.2 |

*Primary Examiner*—Trygve M. Blix
*Assistant Examiner*—Charles E. Frankfort
*Attorney, Agent, or Firm*—Murray Robinson; Ned L. Conley; David Alan Rose

[57] ABSTRACT

The eccentric journals of a tandem roller stabilizer are azimuthally positioned relative to each other by cylindrical pins removably disposed in cylindrical holes extending off-axially parallel to the stabilizer axis, the holes being formed by semi-circular cross-section grooves in the outer periphery of the mandrel and correlative semi-circular cross-section grooves in the inner peripheries of the journals.

7 Claims, 7 Drawing Figures

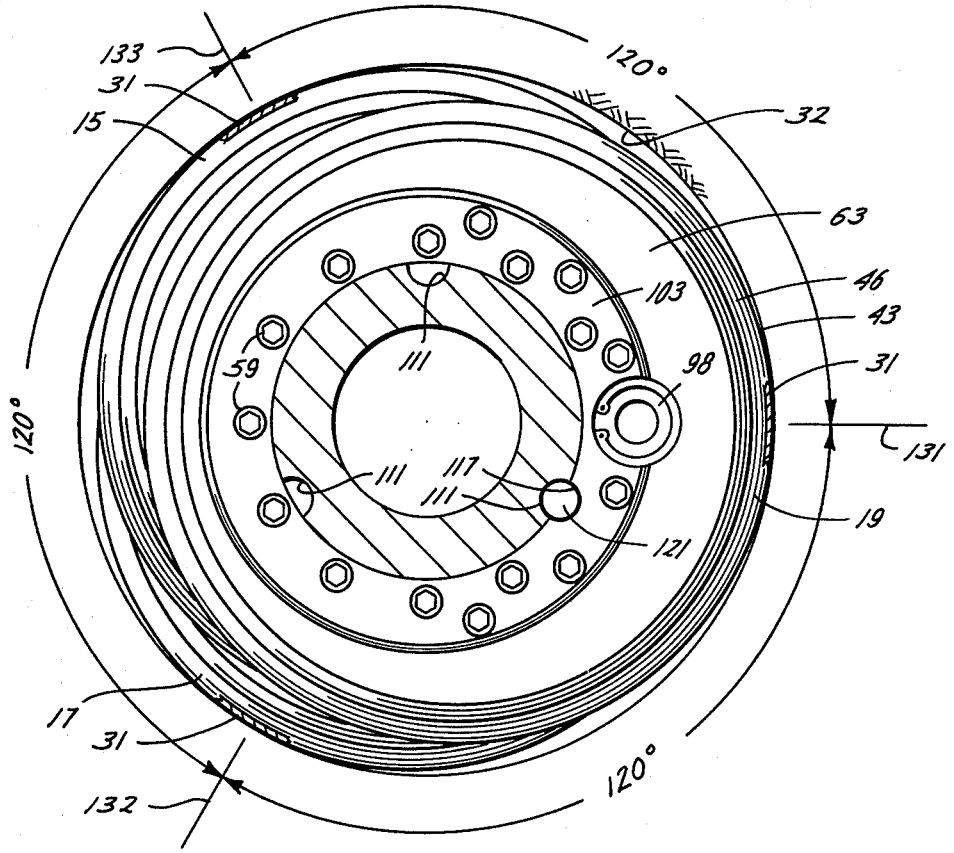
Fig. 4
Fig. 5
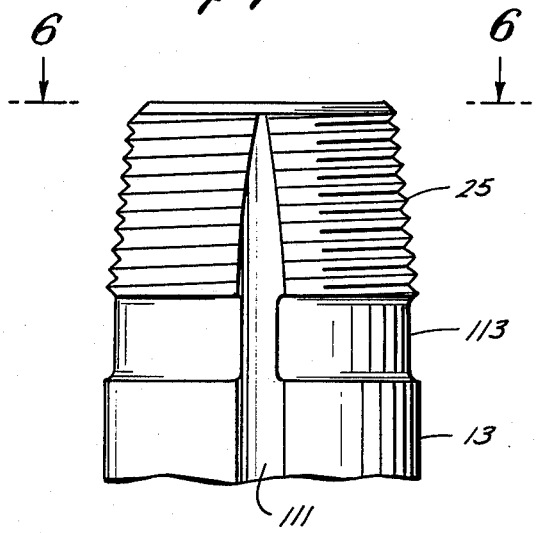
Fig. 6
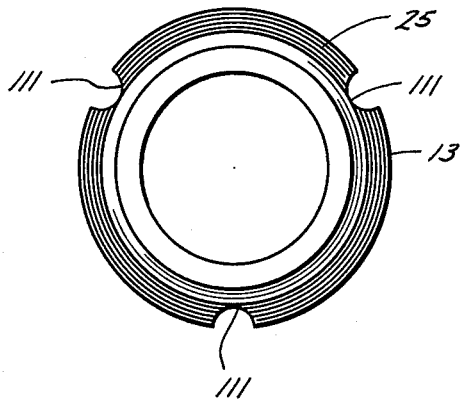

TANDEM ROLLER STABILIZER FOR EARTH BORING APPARATUS

CROSS-REFERENCE TO RELATED APPLICATIONS

The invention herein disclosed is an improvement upon the invention disclosed in the contemporaneously filed application of Jackson M. Kellner entitled STABILIZER, Ser. No. 720,695, filed Sept. 7, 1976.

BACKGROUND OF THE INVENTION

This invention relates to earth boring apparatus and more particularly to roller stabilizers useful in the rotary system of boring blast holes.

Difficulty has been experienced with stabilizers of the type employing plural colevel rollers mounted on parallel off-axial journals when the hole size is increased, e.g., up to 15 or more inches in diameter. Larger bearing diameters are needed to accommodate the large lateral loads without undue wear. A similar problem arises with roller reamers, which are similar to roller stabilizers, the latter being under gage while reamers are full gage. A solution to the problem is the employment of tandem rollers mounted on eccentric journals extending around the stabilizer mandrel. Such construction is already known, e.g. in roller stabilizers, as shown in U.S. Pat. No. 3,400,773 to TIRAPOLSKY et at. See also U.S. Pat. No. 1,772,491 to Koppl and U.S. Pat. Nos. 1,776,611 to Akeyson and 3,982,594 to Berthiaume.

With tandem rollers it is necessary to orient the eccentric journals azimuthally relative to each other in order to distribute the lateral loading uniformly about the axis of the reamer mandrel. Otherwise the rollers would cause the mandrel to deflect and reduce the effectiveness of the reamer. In this regard Tirapolsky, referring to the elements on which the rollers rotate as hubs, states:

> "A suitable assembly can be obtained by connecting the hubs of the consecutive reaming elements by coupling rings in which the hubs are screwed but it is very difficult in this way to obtain a correct relative angular positioning of the axes of the hubs around the axis of the body of the remaining tool.
>
> Another solution is the use of a shaft for the reaming tool on which eccentric hubs are mounted and the rollers turn on these hubs on axes parallel to the shaft with the hubs being fastened to the shaft for rotation either by keying on the shaft or by utilization of a shaft having a polygonal section.
>
> Any of the solutions discussed above require a shaft having a cross-section sufficient to transmit large forces of rotation to the reaming elements.
>
> An object of the present invention is to provide a rigid assembly of reaming elements in which the transmission of the torque to these reaming elements is provided by the assembly itself which is solidly and directly connected to the driving shaft of the bottom motor which drives the tool in rotation."

Tirapolsky employs rings between his hubs, the rings having eccentric sockets to receive and position the hubs, which are largely out of contact with the mandrel.

Koppl employs a polygonal section shaft, as mentioned by Tirapolsky.

SUMMARY OF THE INVENTION

According to the invention the several eccentric journals of a tandem roller stabilizer are azimuthally positioned to each other by cylindrical pins removably disposed in cylindrical holes extending off-axially parallel to the stabilizer axis, the holes being formed by semi-circular cross-section grooves in the outer periphery of the mandrel and correlative semi-circular cross-section grooves in the inner peripheries of the journals.

BRIEF DESCRIPTION OF THE DRAWINGS

For a more detailed description of a preferred embodiment of the invention reference will now be made to the accompanying drawings wherein:

FIG. 4 is a transverse section taken on the plane indicated at 4—4 on FIG. 1 and showing a bottom end view of the several roller assemblies shown in FIG. 1;

FIG. 5 is a fragmentary view showing the pin at the upper end of the mandrel in elevation;

FIG. 6 is a top view of the mandrel; and

DESCRIPTION OF PREFERRED EMBODIMENT

Stabilizer Assembly

Figure 1:
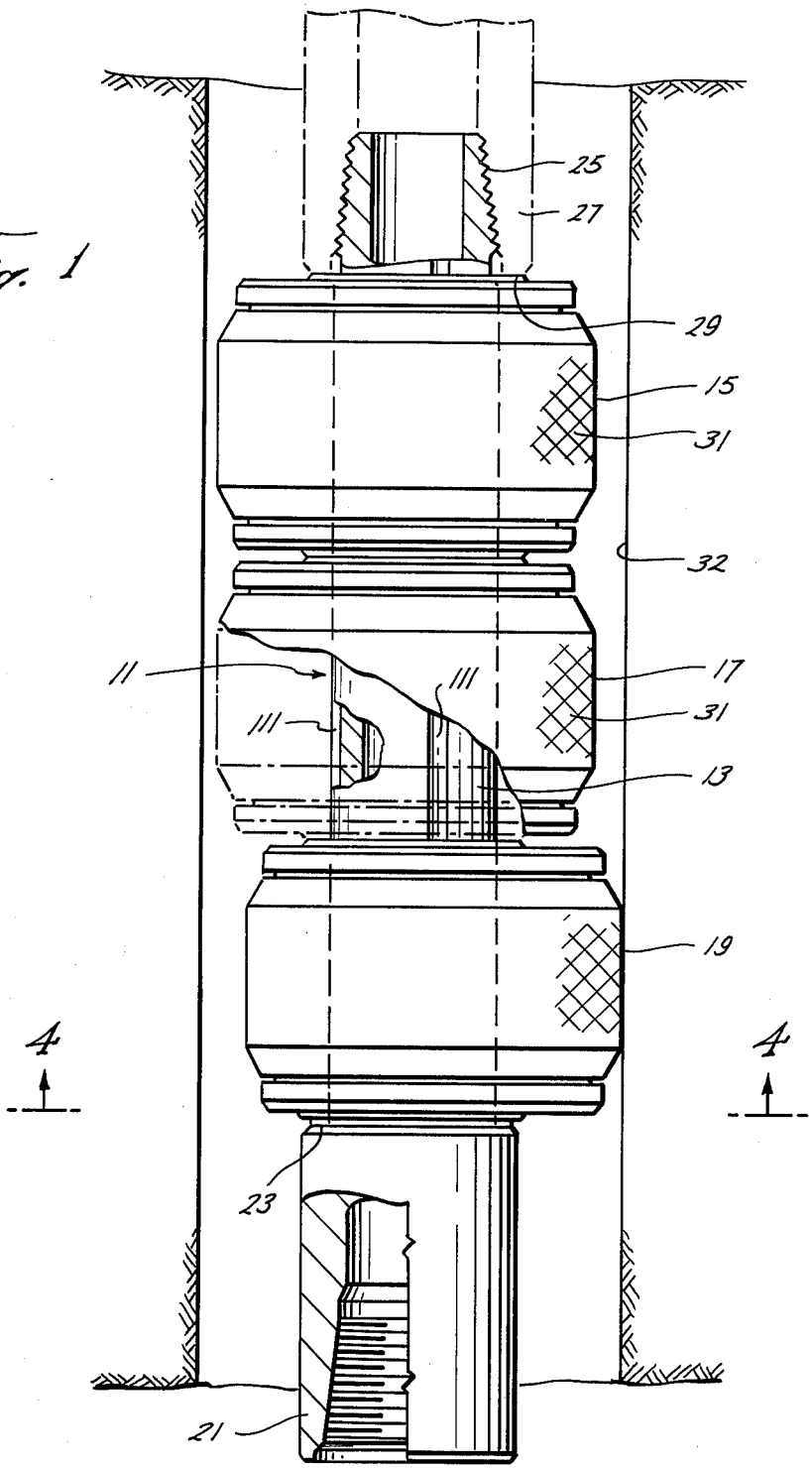
FIG. 1 is a side elevation of a stabilizer embodying the invention, one of the roller assemblies being partially broken away to expose the mandrel.

Referring now to FIG. 1 there is shown a stabilizer comprising a tubular body 11 including mandrel portion 13, the outer periphery of which is adpated to receive the roller assemblies 15, 17, 19. Adjacent one end of the mandrel the body is provided with an internally taper threaded box 21 for making a rotary shouldered connection with an adjacent drill string member, e.g. a bit. For a more detailed disclosure of rotary shouldered connections see U.S. Pat. No. 3,754,609 to Garrett.

A shoulder 23 is formed at the juncture of the box 21 and the mandrel 11, providing stop means at one end of the mandrel limiting axial motion of the roller assemblies relative to the mandrel in the direction toward the box 21. At the other end of the mandrel the body 11 is provided with an externally taper threaded pin 25 for making a rotary shouldered connection with another drill string member, e.g. a tool joint box 27 on the lower end of a drill collar or a sub. The shoulder 29 provided by the mouth of the box 27 provides stop means to prevent axial motion of the roller assemblies relative to the mandrel in the direction toward pin 25. When the box 27 is made up tight on pin 25 the roller assemblies are axially compressed against shoulder 23 and transmit torque between the shoulder 29 and shoulder 23 in the manner described in the aforementioned Garrett patent, and to some degree in the manner described in the aforementioned Tirapolsky et al patent.

The outer peripheries of the roller assemblies are provided with suitable wear reducing means such as inserted tungsten carbide buttons, as is disclosed in the 1974–75 edition of the Composite Catalogue of Oil-field Equipment and Services at page 1774 in U.S. Pat. Nos.

3,667,817 (Kellner), 3,285,678 (Garrett & Crews), and 3,306,381 (Garrett & Moore). Generalized wear reducing means is indicated at 31 on each of the roller assemblies. Such means 31 on roller assembly 19 is shown to be in contact with the wall 32 of the bore hole.

Referring now to FIG. 4, the wall contacting portions of the other roller assemblies are displaced azimuthally from that of the adjacent roller assemblies by an angle X equal to 360° divided by the number of roller assemblies. With three roller assemblies the wall contacting portions are spaced apart 120°. Orienting means for effecting this result will be described later on hereinafter. Any desired number of roller assemblies can be used, for example two through six or more roller assemblies.

ROLLER ASSEMBLY

Figure 2:
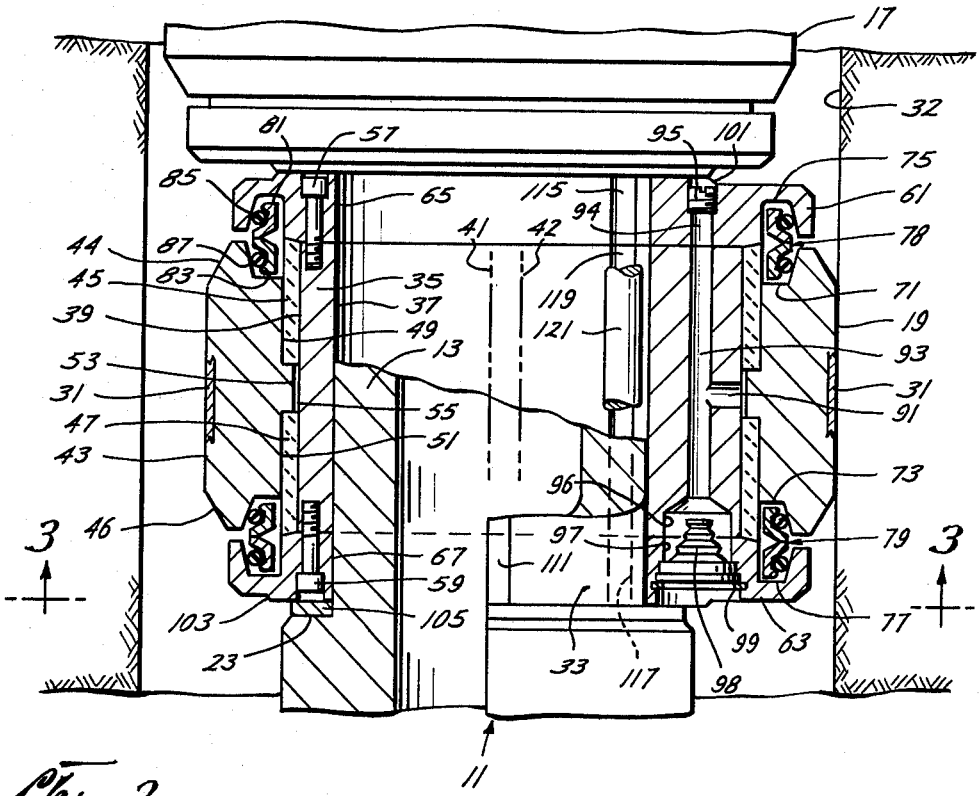
FIG. 2 is an axial section through one of the roller assemblies and associated portions of the mandrel on which it is mounted.

Referring now to FIG. 2, the mandrel 13 has a smooth cylindrical outer periphery 33 about which are disposed the three roller assemblies 15, 17, 19. Each roller assembly, e.g. 19, includes a journal 35 having a smooth cylindrical bore 37 received on the outer periphery of the mandrel.

The outer periphery 39 of the journal is a smooth cylindrical surface eccentric to the bore 37 of the journal and the axis 41 of the mandrel. The journal axis is indicated at 42.

Rotatably mounted on journal 35 is generally cylindrical annular roller 43. The roller 43 is of about the same axial extent as journal 35 and its upper and lower ends are bevelled at 44, 46. Wear reducing means 31 on the outer periphery of the roller is concentric with journal axis 42.

Bushings 45, 47 of bronze or other suitable bearing material are received within cylindrical bores 49, 51 in the ends of the roller. Bushings 45, 47 provide radial bearing means for the rollers cooperating with journal 35 eccentrically rotatably mounting the roller on the stabilizer body.

Bushings 45, 47 may be press fitted or soldered in place within roller 43. The inner diameters of the bushings are smaller than the inner diameter of the mid-portion 53 of the inner periphery of roller 43. This leaves an annular space 55 between the roller and the journal which is filled with lubricating and cooling fluid, preferably a liquid, such as oil.

Secured to the upper and lower ends of journal 35 by rings of cap screws or bolts 57, 59 (see also FIG. 3) are end plates 61, 63. The end plates are eccentrically apertured at 65, 67 to fit snugly around the mandrel. The outer peripheries of the end plates are of larger diameter than the journal, extending out over the ends of the roller, just even with the smallest diameter portions of bevels 44, 56. The plates overlap the ends of the bushings 45, 47 and prevent axial motion of the roller 43 relative to the journal 35. The plates and bushings thus form thrust bearings.

The inner portions of the ends of the roller are provided with annular pockets 71, 73. The seal plates are provided with annular pockets 75, 77 registering with pockets 71, 73. Disposed within the upper pair of pockets 71, 75 is a suitable rotating seal means 78. A similar rotating seal means 79 is disposed in the lower pair of pockets 73, 77. Preferably, as shown, each such seal means is a seal made by the Caterpillar Tractor Company known in the art as a Caterpillar seal. Such a seal comprises a pair of flat faced metal bearing rings 81, 83 urged into contact by a pair of elastomeric toruses or O-rings 85, 87. The outer walls of the pockets in the end plates and the outer peripheries of the bearing rings are tapered so that the O-rings exert axial pressure on the bearing rings to cause a seal therebetween. One bearing ring of each seal means remains stationary relative to the adjacent end plate and the other bearing ring turns with the adjacent roller.

The clearance space between the end plates, roller, and journal, including space 55, sealed off by the seal means 78, 79, provides a reservoir for the lubricating and cooling liquid or oil. Radial and axial passages 91, 93 in the thickest part of the journal connect space 55 with fill port 94 in the end plate at the upper end of the roller. Fill port 94 is closed by a screw plug 95. An enlargement 96 at the lower end of axial passage 93 is in register with port 97 in the lower end plate 63. Port 97 is closed by means of a suitable volume compensator such as a flexible diaphragm 98 releasably held in place by a split resilient ring 99. The volume compensator allows the oil in the reservoir to expand when heated, thereby preventing oil loss through the seal means 78, 79. Volume compensators are disclosed in U.S. Pat. No. 3,413,045 to Wohlfeld. Compare also U.S. Pat. No. 3,463,270 to Lundstrom et al filed Aug. 26, 1969.

The end plates 61, 63 are provided with annular bosses 101, 103. These bosses engage like bosses on the end plates of adjacent roller assemblies, except the lowermost boss engages a washer 105 adjacent shoulder 23 on the stabilizer body and the uppermost boss engages the shoulder 29 formed by the lower end of the tool joint box 27. It is through these bosses that most of the torque is transmitted to and through the roller assemblies from shoulder 23 to shoulder 29 when the reamer is in use, only a small fraction of the torque being transmitted through the threads of box 25 to the stabilizer body.

ROLLER ASSEMBLY ORIENTATION

Referring again to FIG. 1, and also to FIGS. 5 and 6, the body 11 is provided with a plurality (in this case three) of axially extending grooves 111, equal in number $n$ to 360° divided by the desired azimuthal spacing $x$ of the common eccentric diameters of the rooler assemblies. By common eccentric diameter is meant the diameter joining the center of the journal's inner periphery and the center of the journal's outer periphery. The common eccentric diametral plane may be defined as the plane containing all the common eccentric diameters.

Grooves 111 are of semi-circular cross-section, in other words, their surfaces are hemi-cylindrical. The grooves 111 extend along the generally cylindrical mandrel 13 from adjacent shoulder 23 to the pin 25, see FIG. 6, crossing the stress relief groove 113 between the mandrel and threaded portion of the pin and running out in the taper of the pin.

Figure 7:
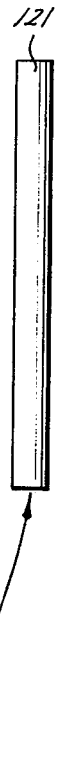
FIG. 7 is an elevation of one of the three alignment pins.
Figure 3:
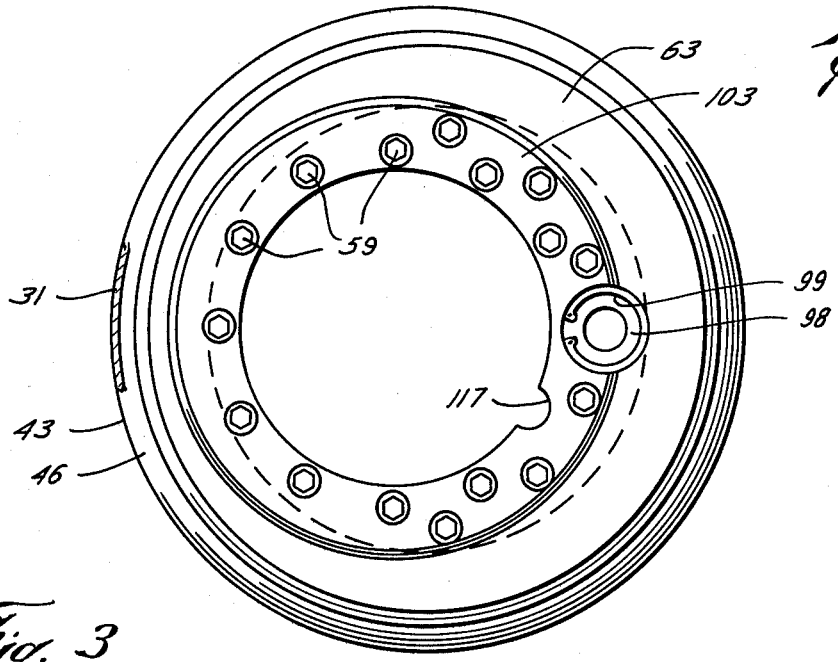
FIG. 3 is a transverse section taken on a plane indicated at 3—3 on FIG. 2 and showing a bottom end view of the roller assembly shown in FIG. 2.

Referring now to FIGS. 2 and 3, each of the roller assemblies is provided with aligned grooves 115, 117, 119 on the inner peripheries of the end plates 61, 63 and the journal 35. The grooves are of like semi-circular cross-section the same as grooves 111 in the mandrel. When aligned with one of grooves 111 they form a cylindrical hole adapted to receive a cylindrical pin, e.g. as shown at 121 in FIGS. 4 and 7.

Each roller assembly will have its own pin 121 anchoring it to the mandrel and each assembly will house its pin positioned in one of the grooves 111 that is displaced by angle $x$ (in this case $x=120°$) from the grooves 111 to which the adjacent roller assemblies are pinned. With the roller assemblies thus pinned to the mandrel, their common eccentric diameters 131, 132, 133 will be displaced azimuthally by the angle $x$ (120° in present example), as shown in FIG. 4. If desired a larger number of roller assemblies than three could be used, e.g. four displaced 90° from each other, or five displaced 72°, etc with the appropriate number of grooves in the mandrel. Less than three roller assemblies would be undesirable, since if only two roller assemblies were used the apparatus would have less lateral stability and if only one roller assembly were used the apparatus would have less lateral stability and if only one roller assembly were used the apparatus would not centralize the drill pipe connected thereto.

If desired, there can be plural roller assemblies positioned by each single groove on the mandrel. For example six roller assemblies could be stacked on the mandrel with every third assembly being pinned to the same mandrel groove. This would amount to a double stack of roller assemblies with three assemblies in each stack. In general the number $n$ of grooves in the mandrel is $$n = N/s$$

where N is the number of roller assemblies and $s$ is the number of stacks. Since the groove spacing $x$ is equal to $360°/n$, we have $$x = (360)(S/N).$$

The orientation method allows all of the roller assemblies to be made alike. Each roller assembly may be assembled by placing it on the mandrel and then turning the assembly on the mandrel until its grooves 115, 117, 119 are aligned with the proper groove 111 and dropping its pin in place or by placing the pin in the roller assembly first and then slipping the assembly onto the mandrel with the pin 121 in the desired groove 111. The lowermost pin 121 will bottom on washer 105 (or on shoulder 23 if washer 105 is omitted). The next pin 121, e.g. of assembly 17, will bottom on the upper end plate 61 of the assembly therebelow (e.g. of assembly 19) since the groove 115 thereon will not be aligned with the pin.

It is to be noted that because the several roller assemblies are in axial compression between the mandrel box and the drill collar box, not only is torque between the drill collar and mandrel largely transmitted by friction from box to end plate to journal, etc., but torque between the journals (and end plates) and mandrel is also largely taken by such frictional engagement, thereby reducing the load on the cylindrical orientation pins.

When the earth formation reducing means or the bearings or other part of the rollers wears out the roller assemblies can be easily removed for replacement by unscrewing the box 27 and pushing the roller assemblies off the mandrel, for the journals are axially slidable on the mandrel. Substitute roller assemblies can then be slipped on the mandrel and oriented by means of the above-described means. The box 27 is then screwed back on and tightened and the reamer is renewed.

Although the subject invention is intended for use as a stabilizer, e.g. for blast hole drilling, it is of more general utility, and its principles may also be employed for reamers. For this reason the invention may be referred to in the claims as a Wall Contacting Tool.

While a preferred embodiment of the invention has been shown and described modifications thereof can be made by one skilled in the art without departing from the spirit of the invention.

I claim:

1. Wall contacting tool, comprising a tubular body including a portion providing a mandrel having a generally cylindrical outer periphery, a plurality of eccentric roller assemblies disposed in tandem along the length of the mandrel, and orientation means for positioning said roller assemblies with their common eccentric diameters in desired azimuthal orientation about the mandrel axis, said orientation means comprising:

a plurality of grooves of semi-circular cross-section extending axially in the outer periphery of the mandrel and being spaced azimuthally about the axis of the mandrel, groove means of semi-circular cross-section extending axially in the inner periphery of each roller assembly, said groove means in each roller assembly being adjacent a different one of said grooves in the mandrel and forming therewith a cylindrical opening, and a cylindrical pin in each said opening, said pins being aximuthally spaced apart about the axis of the mandrel.

2. Wall contacting tool comprising:

a tubular body including a portion providing a mandrel having a generally cylindrical outer periphery, a plurality of eccentric roller assemblies disposed in tandem along the length of the mandrel, and orientation means for positioning said roller assemblies with their common eccentric diameters in desired azimuthal orientation about the mandrel axis, said orientation means comprising:

a plurality of grooves of semi-circular cross-section extending axially in the outer periphery of the mandrel and being spaced azimuthally about the axis of the mandrel, groove means of semi-circular cross-section extending axially in the inner periphery of each roller assembly, said groove means in each roller assembly being adjacent a different one of said grooves in the mandrel and forming therewith a cylindrical opening, and a cylindrical pin in each said opening, each roller assembly including:

a journal having a cylindrical outer periphery and a cylindrical opening therethrough whose axis is parallel to but eccentric with respect to the axis of the outer periphery of the journal, said cylindrical opening receiving said mandrel, a roller rotatably mounted on such journal, and an annular plate at each end of the journal secured thereto and extending radially over the adjacent end of the roller, said groove means in each roller assembly including a groove in said opening in said journal and aligned grooves in said annular plates, said roller assemblies all being alike.

3. Wall contacting tool comprising a tubular body including a portion providing a mandrel having a generally cylindrical outer periphery, a plurality of eccentric roller assemblies disposed in tandem along the length of the mandrel, and orientation means for positioning said roller assemblies with their common eccentric diameters in desired azimuthal orientation about the mandrel axis, said orientation means comprising:

a plurality of grooves of semi-circular cross-section extending axially in the outer periphery of the mandrel, groove means of semi-circular cross-section extending axially in the inner periphery of each roller assembly, said groove means in each roller assembly being adjacent a different one of said grooves in the mandrel and forming therewith a cylindrical opening, and a cylindrical pin in each said opening, each roller assembly including:

a journal having a cylindrical outer periphery and a cylindrical opening therethrough whose axis is parallel to but eccentric with respect to the axis of the outer periphery of the journal, said cylindrical opening receiving said mandrel, a roller rotatably mounted on such journal, and an annular plate at each end of the journal secured thereto and extending radially over the adjacent end of the roller, said groove means in each roller assembly including a groove in said opening in said journal and aligned grooves in said annular plates, said body including a threaded box at one end having an outer diameter greater than that of the mandrel forming a shoulder at the juncture therebetween, the other end of said body tapering down from the mandrel diameter to a lesser diameter and being externally threaded providing a threaded pin for making connection with a correlative box, and grooves along the length of said threaded pin forming continuation of said grooves in the mandrel to pass said cylindrical pins when said roller assemblies are assembled on said mandrel, the ends of said grooves in the manrel and in the roller assembly at the threaded pin end of the mandrel and the cylindrical pin in the cylindrical opening between the mandrel and the roller assembly at the threaded pin end of the mandrel being adapted to be covered by such correlative box when screwed onto said threaded pin.

4. Wall contacting tool comprising a tubular body including a portion providing a mandrel having a generally cylindrical outer periphery, a plurality of eccentric roller assemblies disposed in tandem along the length of the mandrel, and orientation means for positioning said roller assemblies with their common eccentric diameters in desired azimuthal orientation about the mandrel axis, said orientation means comprising:

a plurality of grooves of semi-circular cross-section extending axially in the outer periphery of the mandrel, groove means of semi-circular cross-section extending axially in the inner periphery of each roller assembly, said groove means in each roller assembly being adjacent a different one of said grooves in the mandrel and forming therewith a cylindrical opening, and a cylindrical pin in each said opening, each roller assembly including:

a journal having a cylindrical outer periphery and a cylindrical opening therethrough whose axis is parallel to but eccentric with respect to the axis of the outer periphery of the journal, said cylindrical opening receiving said mandrel, a roller rotatably mounted on such journal, and an annular plate at each end of the journal secured thereto and extending radially over the adjacent end of the roller, said groove means in each roller assembly including a groove in said opening in said journal and aligned grooves in said annular plates, said body including a threaded box at one end having an outer diameter greater than that of the mandrel forming a shoulder at the juncture therebetween, the other end of said body tapering down from the mandrel diameter to a lesser diameter and being externally threaded providing a threaded pin for making connection with a correlative box, and grooves along the length of said threaded pin forming continuations of said grooves in the mandrel to pass said cylindrical pins when said roller assemblies are assembled on said mandrel, the ends of said grooves in the mandrel and in the roller assembly at the threaded pin end of the mandrel and the cylindrical pin in the cylindrical opening between the mandrel and the roller assembly at the threaded pin end of the mandrel being adapted to be covered by such correlative box when screwed onto said threaded pin, in combination with a drill collar having at one end such a correlative box connected to said threaded pin and holding said roller assemblies on said mandrel, said journals and plates being held in compression between said drill collar box and the box on said tubular body at the other end of said mandrel from said drill collar, whereby torque is transmitted from said drill collar box to said box on the tubular body and said journals are held in desired azimuthal position on said mandrel by friction between said journals, plates, and boxes and said threaded pin, and said cylindrical pins do not take all the torque between said boxes and between said journals and mandrel.

5. Wall contacting tool comprising a tubular body including a portion providing a mandrel having a generally cylindrical outer periphery, a plurality of eccentric roller assemblies disposed in tandem along the length of the mandrel, and orientation means for positioning said roller assemblies with their common eccentric diameters in desired azimuthal orientation about the mandrel axis, said orientation means comprising:

a plurality of grooves of semi-circular cross-section extending axially in the outer periphery of the mandrel, groove means of semi-circular cross-section extending axially in the inner periphery of each roller assembly, said groove means in each roller assembly being adjacent a different one of said grooves in the mandrel and forming therewith a cylindrical opening, and a cylindrical pin in each said opening, each roller assembly including:

a journal having a cylindrical outer periphery and a cylindrical opening therethrough whose axis is parallel to but eccentric with respect to the axis of the outer periphery of the journal, said cylindrical opening receiving said mandrel, a roller rotatably mounted on such journal, and an annular plate at each end of the journal secured thereto and extending radially over the adjacent end of the roller, said groove means in each roller assembly including a groove in said opening in said journal and aligned grooves in said annular plates, said groove in each journal being disposed in the thickest quadrant of the journal, but to one side of the common eccentric diametral plane, each journal being provided with a lubrication reservoir extending parallel to the axis of the journal outer periphery and transecting the common eccentric diametral plane.

6. Wall contacting tool comprising a tubular body including a portion providing a mandrel having a generally cylindrical outer periphery, a plurality of eccentric roller assemblies disposed in tandem along the length of the mandrel, and orientation means for positioning said roller assemblies with their common eccentric diameters in desired azimuthal orientation about the mandrel axis, said orientation means comprising:

a plurality of grooves of semi-circular cross-section extending axially in the outer periphery of the mandrel, groove means of semi-circular cross-section extending axially in the inner periphery of each roller assembly, said groove means in each roller assembly being adjacent a different one of said grooves in the mandrel and forming therewith a cylindrical opening, and a cylindrical pin in each said opening, each roller assembly including:

a journal having a cylindrical outer periphery and a cylindrical opening therethrough whose axis is parallel to but eccentric with respect to the axis of the outer periphery of the journal, said cylindrical opening receiving said mandrel, a roller rotatably mounted on such journal, and an annular plate at each end of the journal secured thereto and extending radially over the adjacent end of the roller, said groove means in each roller assembly including a groove in said opening in said journal and aligned grooves in said annular plates, said body including a threaded box at one end having an outer diameter greater than that of the mandrel forming a shoulder at the juncture therebetween, the other end of said body tapering down from the mandrel diameter to a lesser diameter and being externally threaded providing a threaded pin for making connection with a correlative box, and grooves along the length of said threaded pin forming continuations of said grooves in the mandrel to pass said cylindrical pins when said roller assemblies are assembled on said mandrel, said tubular body including a stress relief groove therearound between the mandrel and threaded pin, said grooves in the mandrel and threaded pin being connected by grooves across said stress relief groove.

7. Wall contacting tool comprising a tubular body including a portion providing a mandrel having a generally cylindrical outer periphery, a plurality of eccentric roller assemblies disposed in tandem along the length of the mandrel, and orientation means for positioning said roller assemblies with their common eccentric diameters in desired azimuthal orientation about the mandrel axis, said orientation means comprising:

a plurality of grooves of semi-circular cross-section extending axially in the inner periphery of each roller assembly, said groove means in each roller assembly being adjacent a different one of said grooves in the mandrel and forming therewith a cylindrical opening, and a cylindrical pin in each said opening, said grooves in the mandrel being equiangularly spaced apart by the angle $x$ where $$X = (360)\,(s/N)$$

where N is the total number of roller assemblies and $s$ is the number of stacks of similarly positioned roller assemblies, said groove means in each roller assembly being in the same azimuthal position with respect to the common eccentric diameter of the roller assembly.

* * * * *

UNITED STATES PATENT AND TRADEMARK OFFICE

CERTIFICATE OF CORRECTION

PATENT NO. : 4,082,373

DATED : April 4, 1978

INVENTOR(S) : Jackson M. Kellner

It is certified that error appears in the above-identified patent and that said Letters Patent are hereby corrected as shown below:

Column 1, line 29, change "at" to -al-.
Column 4, line 43, change "rooler" to -roller-.
Column 4, line 51, change "hemi-cylindrical" to -semi-cylindrial-.
Column 5, line 12, delete "the apparatus".
Column 5, line 13, delete the entire line.
Column 5, line 14, delete "assembly were used."
Column 6, line 26, change "aximuthally" to -azimuthally-.
Column 7, line 37, change "continuation" to -continuations-.
Column 7, line 41, change "manrel" to -mandrel".

Signed and Sealed this

*First* Day of *May 1979*

[SEAL]

*Attest:*

RUTH C. MASON
*Attesting Officer*

DONALD W. BANNER
*Commissioner of Patents and Trademarks*